US006118366A

United States Patent [19]

Bulgatz et al.

[11] Patent Number: 6,118,366

[45] Date of Patent: Sep. 12, 2000

[54] ELECTROMAGNETIC ACTUATOR WITH SPLIT HOUSING ASSEMBLY

[75] Inventors: Dennis Bulgatz, Williamsburg; Robert W. McFarland, Newport News, both of Va.

[73] Assignee: Siemens Automotive Corporation, Auburn Hills, Mich.

[21] Appl. No.: 09/181,513

[22] Filed: Oct. 28, 1998

Related U.S. Application Data

[60] Provisional application No. 60/069,144, Dec. 9, 1997.

[51] Int. Cl.[7] ..... H01F 27/24

[52] U.S. Cl. ..... 336/234; 336/212; 29/605

[58] Field of Search ..... 336/234, 210, 336/212, 60, 233; 29/605, 609

[56] References Cited

U.S. PATENT DOCUMENTS

| | | | |
|---|---|---|---|
| 2,239,267 | 4/1941 | Jeffrey | 175/341 |
| 2,352,765 | 7/1944 | Bierenfeld et al. | 175/336 |
| 2,460,145 | 1/1949 | Pfuntner et al. | 336/234 |
| 2,480,057 | 8/1949 | Soreng et al. | 175/341 |
| 2,513,900 | 7/1950 | Thomander | 171/95 |
| 2,556,013 | 6/1951 | Thomas | 171/252 |
| 2,692,354 | 10/1954 | Fisher | 317/191 |
| 2,715,199 | 8/1955 | Bogue et al. | 317/191 |
| 2,931,966 | 4/1960 | Rocky | 336/212 |
| 3,058,039 | 10/1962 | Ray | 317/198 |
| 3,110,874 | 11/1963 | Dowdle et al. | 336/234 |
| 3,538,601 | 11/1970 | Nerot et al. | 29/609 |
| 3,821,671 | 6/1974 | Grunert et al. | 335/132 |
| 4,518,942 | 5/1985 | Geschka | 336/178 |
| 4,546,753 | 10/1985 | Pierret | 123/634 |
| 5,176,946 | 1/1993 | Wieloch | 428/138 |

*Primary Examiner*—Lincoln Donovan
*Assistant Examiner*—Tuyen T. Nguyen

[57] ABSTRACT

A method of securing a core of an electromagnetic device to a housing assembly is provided. The core includes a stack of a plurality of laminations. Each of the laminations has a plurality of apertures extending therethrough which cooperate to define a plurality of apertures through the core. The core has generally planar ends. The housing assembly includes first and second housing portions constructed and arranged to receive the core. Each housing portion has first and second opposing surfaces with the first surface defining a generally planar contact surface. Each housing portion includes a recess extending inwardly from the contact surface and a plurality of apertures extending from the first surface to the second surface. The apertures in the housing portions are disposed at locations corresponding to locations of the apertures in the core. The method includes arranging the core between the first and second housing portions such that the apertures in the housing portions align generally with the apertures in the core. A fastener is then inserted through each of the apertures in the first housing portion, through each of the apertures in the core and through each of the corresponding apertures in the second housing portion in such a manner to secure the core to the first and second housing portions planar end.

14 Claims, 2 Drawing Sheets

ELECTROMAGNETIC ACTUATOR WITH SPLIT HOUSING ASSEMBLY

This Patent Application claims priority to U.S. Provisional Patent Application No. 60/069,144, filed Dec. 9, 1997, the contents of which is hereby incorporated by reference in its entirety herein.

FIELD OF THE INVENTION

This invention relates to an electromagnetic actuator for a vehicle engine and, more particularly, to a method of securing a core of the actuator to a two-component housing assembly so as to accommodate cores having varying lamination stack heights.

BACKGROUND OF THE INVENTION

A conventional electromagnetic actuator for opening and closing a valve of an internal combustion engine generally includes "open" and "close" electromagnets which, when energized, produce an electromagnetic force on an armature. The armature is biased by a pair of identical springs arranged in parallel. The armature is coupled with a cylinder valve of the engine. The armature rests approximately half way between the open and close electromagnets when the springs are in equilibrium. When the armature is held by a magnetic force in either the closed or opened position (at rest against the open or close electromagnet), potential energy is stored by the springs. If the magnetic force is shut off with the armature in the opened position, the spring's potential energy will be converted to kinetic energy of the moving mass and cause the armature to move towards the close electromagnet. If friction is sufficiently low, the armature can then be caught in the closed position by applying current to the close electromagnet.

The conventional electromagnetic actuator has a one-piece housing which is constructed and arranged to contain the core or lamination stack for an electromagnet. It is often the case that the lamination stack height may vary for each electromagnet since the laminated core assembly is composed of many individual laminations each having a certain height dimension within a predetermined tolerance. In certain instances, tolerance stack-up of the many laminations may not permit the overall lamination stack to fit easily within the one-piece housing.

Accordingly, there is a need to provide an electromagnetic actuator having a housing assembly configuration which accounts for varying lamination stack heights to facilitate assembly of the lamination stack with respect to the housing assembly.

SUMMARY OF THE INVENTION

An object of the present invention is to fulfill the need referred to above. In accordance with the principles of the present invention, this objective is obtained by providing a method of securing a core of an electromagnetic device to a housing assembly. The core includes a stack of a plurality of laminations. Each of the laminations has a plurality of apertures extending therethrough which cooperate to define a plurality of apertures through the core. The core has generally planar ends. The housing assembly includes first and second housing portions constructed and arranged to receive the core. Each housing portion has first and second opposing surfaces with the first surface defining a generally planar contact surface. Each housing portion includes a recess extending inwardly from the contact surface and a plurality of apertures extending from the first surface to the second surface. The apertures in the housing portions are disposed at locations corresponding to locations of the apertures in the core. The method includes arranging the core between the first and second housing portions such that the apertures in the housing portions align generally with the apertures in the core. A fastener is then inserted through each of the apertures in the first housing portion, through each of the apertures in the core and through each of the corresponding apertures in the second housing portion in such a manner to secure the core to the first and second housing portions with each planar end of the core being engaged with an associated contact surface. Each end of the core defines, in cooperation with an associated recess, a coil receiving space for receiving a portion of a coil of the electromagnetic device.

In another embodiment of the invention the method includes first inserting a fastener through each of the apertures in the laminations and securing the fasteners with respect to the laminations to join the plurality of laminations together. The fasteners include protruding portions extending from opposing ends of the core and sized to be received in the apertures of the housing portions. Thereafter, the protruding portions are inserted into the apertures of the housing portions with the core disposed between the housing portions. The protruding portions are secured to the housing portions to couple the housing portions to the core.

In accordance with yet another aspect of the invention, a core and housing assembly for an electromagnetic device is provided. The core includes a plurality of stacked laminations and the housing assembly includes first and second housing portions coupled to the core.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
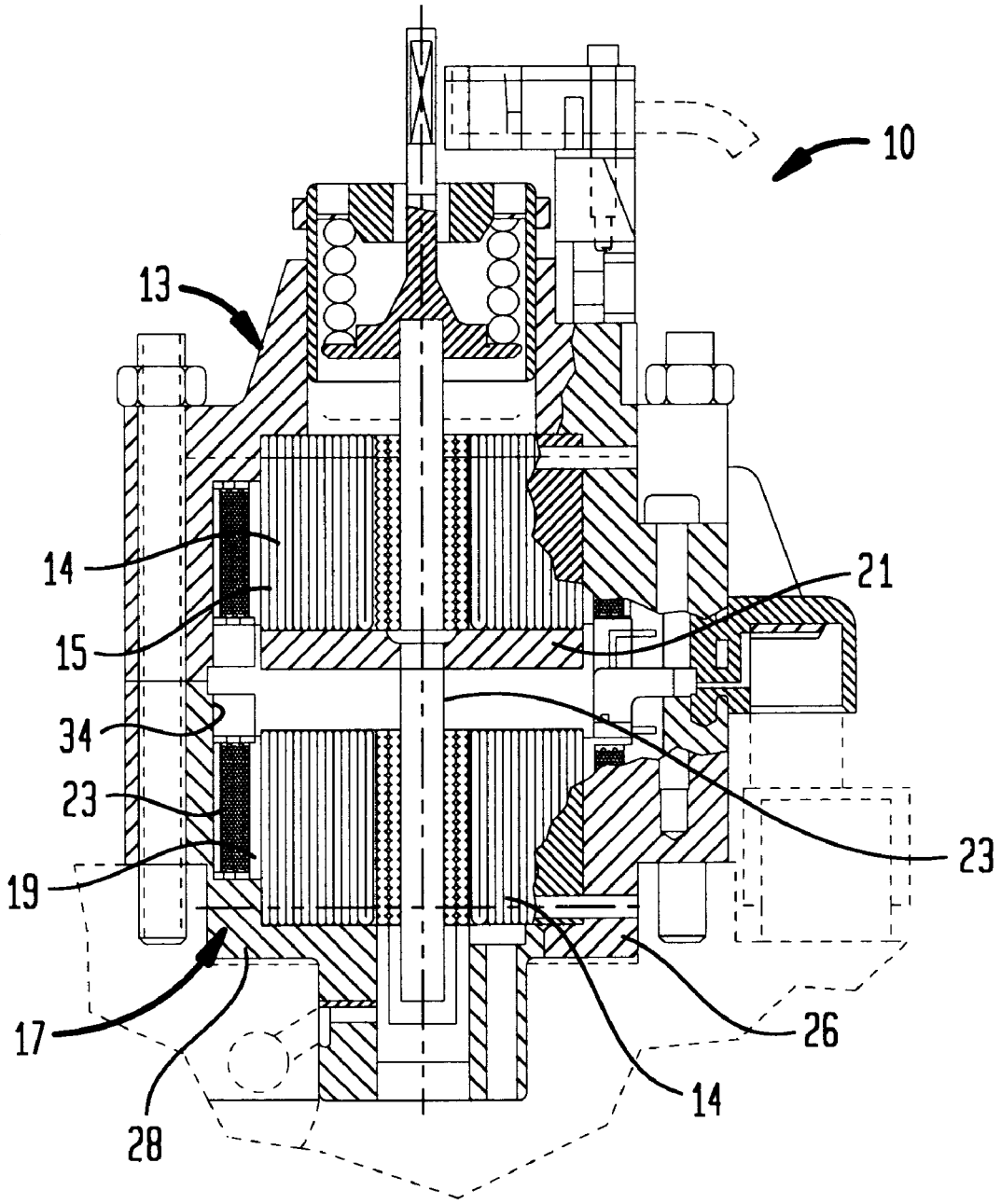
FIG. 1 is a sectional view of an electromagnetic actuator having two-component housing assemblies provided in accordance with the principles of the present invention.

Referring to FIG. 1, an electromagnetic actuator is shown, generally indicated 10, having electromagnet housing assemblies provided in accordance with the principles of the present invention. The electromagnetic actuator 10 includes an upper housing assembly 13 containing an upper electromagnet 15 and a lower housing assembly 17 containing a lower electromagnet 19. An armature 21 is arranged for movement between the electromagnets 15 and 19. The armature 21 is carried by a shaft 23. The shaft 23 is configured to be coupled to a stem of a cylinder valve (not shown) of an engine of a vehicle in the conventional manner.

The invention will be described with regard to the lower electromagnet 19. It will be appreciated, however, that the principles of the invention are applicable to the construction of the upper electromagnet 15 as well. Thus, with reference to FIG. 3, the lower housing assembly 17 and core 14 of electromagnet 19 are shown provided in accordance with the principles of a first embodiment of the present invention. The core 14 comprises a stack of a plurality of laminations 16 preferably composed of a soft magnetic material such as silicon iron. Each lamination 16 is generally E-shaped defining channels 18 to receive a coil assembly 23 (FIG. 1) of the electromagnet 19. Each lamination 16 of the stack includes a plurality of apertures 20 therethrough cooperating to define a plurality of apertures through the core 14. In the illustrated embodiment, four apertures 20 are defined in each lamination 16, however, any number of apertures 20 may be provided. The apertures 20 are sized to receive fasteners therein, the function of which will become apparent below. The core 14 has generally planar ends, 22 and 24, respectively.

Figure 2:
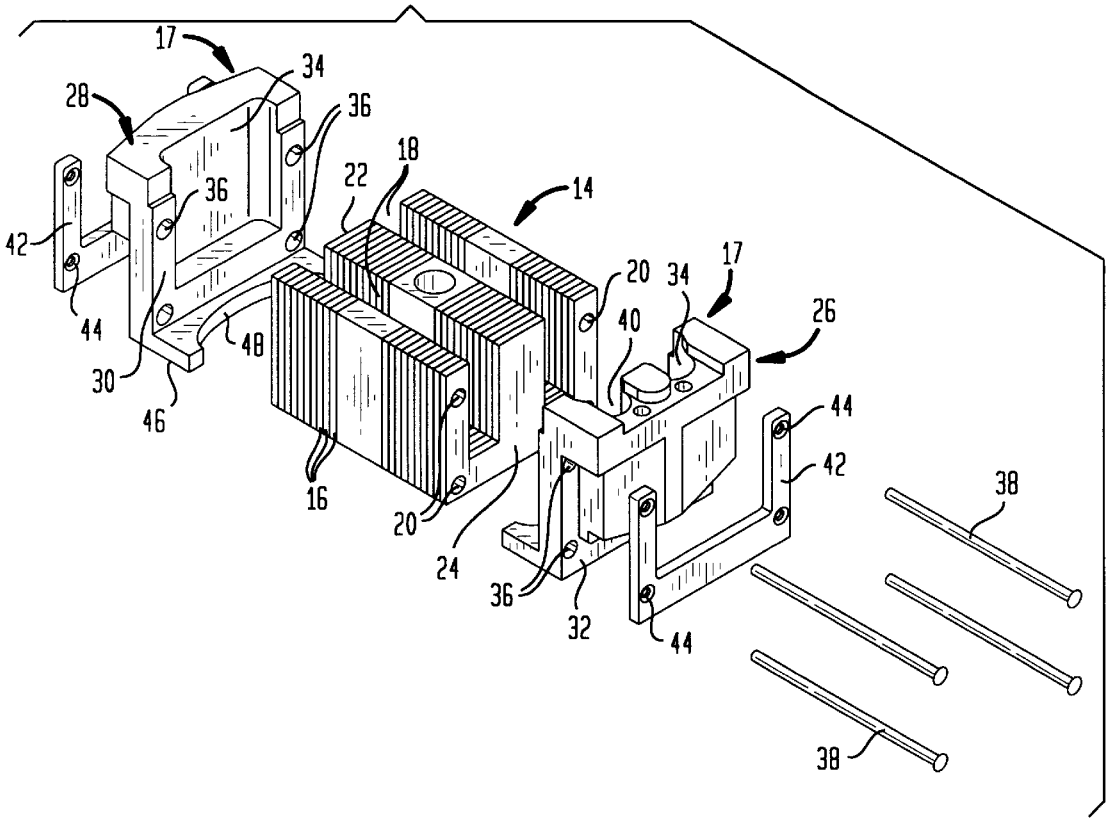
FIG. 2 is an exploded perspective view of a lower housing assembly and core of a lower electromagnet of the electromagnetic actuator of FIG. 2, provided in accordance with the principles of a first embodiment of the present invention.

The housing assembly 17 includes first and second housing portions, 26 and 28, respectively. As best shown in FIG. 2, each housing portion 26 and 28 is constructed and arranged to receive the core 14 and has a first surface 30 and an opposing second surface 32. The first surface 30 defines a generally planar contact surface, the function of which will become apparent below. Each housing portion 26 and 28 includes a recess 34 extending inwardly from the contact or first surface 30, and a plurality of apertures 36 extending from the first surface 30 to the second surface 32. The apertures 36 defined in the housing portions 26 and 28 are disposed at locations corresponding to locations of the apertures 20 in the core 14.

A plurality of fasteners 38 (FIG. 2) are provided to join the housing portions 26 and 28 to the core 14. In the illustrated embodiment, the fasteners are in the form of conventional rivets. It can be appreciated that other types of fasteners could be employed, such as locking pins, screws, bolts, etc.

With reference to FIG. 2, the method of joining the core 14 to the housing portions 26 and 28 is as follows:

First, the core 14 is arranged between the first and second housing portions number 26 and 28 such that the apertures 36 in the housing portions align generally with the apertures 20 in the core 14. Next, a fastener 38 is inserted through each of the apertures 36 in the first housing portion 26, through each of the apertures 20 in the core 14 and through each of the corresponding apertures 36 in the second housing portion 28 in such a manner to secure the core 14 to the first and second housing portions with each planar end 22 and 24 of the core 14 being engaged with a contact surface 30 of an associated housing portion. In the embodiment of FIG. 2, a riveting operation is performed to join the housing portions 26 and 28 to the core 14.

Once assembled, each end 22 and 24 of the core 14 defines, in cooperation with an associated recess 34 of the housing portions, a coil receiving space 40 for receiving an end portion of a coil 23 of the electromagnet (FIG. 1).

It is preferred that the housing portions 26 and 28 be made from magnesium, aluminum or steel. When the housing portions are composed of magnesium or aluminum, a pair of back plates 42, preferably made of steel, are provided. Each back plate 42 includes apertures 44 therein corresponding to the apertures 36 in the first and second housing portions 26 and 28. The housing portions 26 and 28 are disposed between the back plates 42 with a back plate 42 contacting the second surface 32 of an associated housing portion such that loads of the rivets 38 are exerted on the back plates 42.

Each housing portion 26 and 28 of the lower housing assembly 17 preferably includes a bottom flange 46 defining an alignment feature 48 for mounting the actuator 11.

Figure 3:
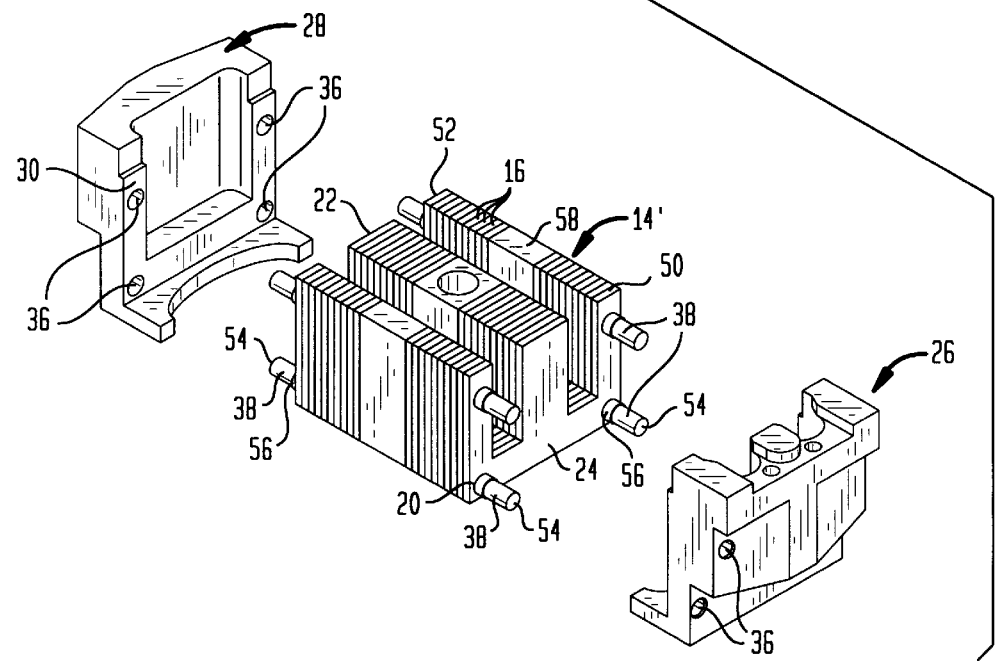
FIG. 3 is an exploded perspective view of a lower housing assembly and core of a lower electromagnet of the electromagnetic actuator of FIG. 2, provided in accordance with the principles of a second embodiment of the present invention.

A second embodiment of the invention is shown in FIG. 3. The housing portions 26 and 28 are identical to that of the embodiment of FIG. 3. The core 14' is generally identical to that of FIG. 2. However, the individual end laminations 50, and 52 have a thickness greater than the thickness of an adjacent lamination, the function of which will be explained below. Further, the way in which the core 14' is fastened to the housing portions is different from that of the first embodiment of the invention. First, a fastener 38 is inserted through each of the apertures 20 in the laminations 16. Each of the fasteners 38 is in the form of a shaft having a protruding portion 54 extending beyond planar surfaces 22 and 24 of the core 14'. In the illustrated embodiment, the fasteners 38 are rivets secured to the core 14' via a locking member 56 so as to join the laminations 16 together. The locking members 56 may be secured to the shaft by crimping or welding. It can be appreciated that one locking member 56 may be pre-fastened to the shaft and then the shaft may be inserted in the aperture 20 until the locking member contacts an end of the core. Thereafter, the second locking member may be used to secure the laminations together. Alternatively, the fasteners 38 may be bolts or screws or may be pins which join the laminations via an interference fit with the apertures 20.

Next, the protruding portions 54 are inserted into the apertures 36 in the housing portions 26 and 28 with the core 14' disposed between the housing portions 26 and 28. The protruding portions 54 are then secured to the housing portions 26 and 28 to couple the housing portions to the core 14'. The protruding portions 54 are preferably secured to the housings portions via a riveting operation. Alternatively, the protruding portions may be secured to the housing portions by a press fit, a locking member, or a weld. Once assembled, each end 22 and 24 of the core 14' is in contact with a contact surface 30 of an associated housing portion.

The end laminations 50 and 52 are made thicker than adjacent laminations so as to support the load of the fasteners 38 and to control expansion of the middle portion 58 of the core 14'.

Since the laminations 16 are secured together, the core 14' and fasteners 38 may expand uniformly under thermal loads, which may prevent or reduce stress on the fastening joints. In addition, in both embodiments of the invention, the core is held by the fasteners in intimate contact with the housing portions which promotes good heat transfer and provides rigidity of the overall structure.

It can be appreciated that since each electromagnet housing assembly is split into two housing portions and rivets are used to join the housing portions to the core or lamination stack, variations in the height of the stack may be easily accounted for during the riveting operation and/or by selecting rivets or fasteners of appropriate length.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A method of securing a core of an electromagnetic device to a housing assembly, the core comprising a stack of a plurality of laminations, each of the laminations having a plurality of apertures extending therethrough which cooperate to define a plurality of apertures through said core, said core having end surfaces, and the housing assembly comprising first and second housing portions constructed and arranged to receive the core, each housing portion having first and second opposing surfaces with the first surface defining a contact surface, each housing portion including a recess extending inwardly from the contact surface, each housing portion further including a plurality of apertures extending from the first surface to the second surface, the apertures in the housing portions being disposed at locations corresponding to locations of the apertures in the core, the method comprising the steps of:

arranging the core between the first and second housing portions such that the apertures in the housing portions align with the apertures in the core; and inserting a fastener through each of the apertures in the first housing portion, through each of the apertures in the core and through each of the corresponding apertures in the second housing portion in such a manner to secure the core to the first and second housing portions with each end surface of the core being engaged with a said contact surface, and with each end of the core defining, in cooperation with surfaces defining a said recess, a coil receiving space for receiving a portion of a coil of the electromagnetic device.

2. The method according to claim 1, wherein said fasteners are rivets and a riveting operation is performed to secure the core to the first and second housing portions.

3. The method according to claim 1, wherein each of said first and second housing portions are made of magnesium, the method further providing a pair of back plates made of steel, each back plate including apertures therein corresponding to apertures in the first and second housing portions, the method including securing the core between the housing portions with the housing portions being disposed between the back plates and with a back plate contacting the second surface of an associated housing portion such that loads of said fasteners are exerted on the back plates.

4. The method according to claim 1, wherein each of said first and second housing portions are made of aluminum, the method further providing a pair of back plates made of steel, each back plate including apertures therein corresponding to apertures in the first and second housing portions, the method including securing the core between the housing portions with the housing portions being disposed between the back plates and with a back plate contacting the second surface of an associated housing portion such that loads of the fasteners are exerted on the back plates.

5. A method of coupling a core of an electromagnetic device to a housing assembly, the core comprising a stack of a plurality of laminations each having a plurality of apertures extending therethrough cooperating to define a plurality of apertures through the core, laminations defining the opposing ends of said core each having a thickness greater than a thickness of an adjacent lamination of said core, and the housing assembly comprising first and second housing portions constructed and arranged to receive the core, each of said housing portions including apertures therein at locations corresponding to locations of the apertures in the laminations, the method comprising the steps of:

inserting a fastener through each of the apertures in said laminations and securing the fasteners with respect to the laminations to join said plurality of laminations together, said fasteners including protruding portions extending from opposing ends of said core and sized to be received in the apertures of the housing portions, and inserting the protruding portions into the apertures of the housing portions with the core disposed between the housing portions and securing the protruding portions to the housing portions to couple the housing portions to the core.

6. The method according to claim 5, wherein said fasteners are rivets secured to the laminations and to the housing portions via a riveting operation.

7. The method according to claim 5, wherein each said fastener is in the form of a shaft, ends of said shaft which define the protruding portions being secured to end laminations of the core with a locking member.

8. The method according to claim 7, wherein said locking member is secured to said shaft via a crimping operation.

9. The method according to claim 7, wherein said locking member is secured to said shaft via a welding operation.

10. A core and housing assembly for an electromagnetic device, said assembly comprising:

a core assembly comprising a stack of a plurality of laminations, each of said laminations having a plurality of apertures extending therethrough and cooperating to define a plurality of apertures extending through said core, said core having first and second ends, a housing assembly comprising first and second housing portions, each housing portion having first and second opposing surfaces with said first surface defining a contact surface, each housing portion including a recess extending inwardly from said contact surface towards said second surface, each housing portion including a plurality of apertures extending from said first surface to said second surface, said apertures in said housing portions corresponding to locations of the apertures in the core; and a plurality of fasteners, each fastener extending through an aperture in said core and into a said aperture in each of said housing portions thereby coupling said housing portions to said core, with the each end of said core contacting a said contact surface, and with each end of said core defining, in cooperation with surfaces defining a said recess, a coil receiving space for receiving a portion of a coil of the electromagnetic device.

11. The assembly according to claim 10, wherein said fasteners are rivets.

12. The assembly according to claim 10, wherein each of said first and second housing portions are made of magnesium, the assembly further including a pair of back plates made of steel, each back plate including apertures therein corresponding to apertures in said first and second housing portions, a back plate contacting the second surface of an associated is housing portion such that a loads of said fasteners are exerted on said back plates.

13. The assembly according to claim 10, wherein each of said first and second housing portions are made of aluminum, the assembly further including a pair of back plates made of steel, each back plate including apertures therein corresponding to apertures in said first and second housing portions, a back plate contacting the second surface of an associated housing portion such that a loads of said fasteners are exerted on said back plates.

14. The assembly according to claim 10, wherein individual laminations defining the opposing ends of said score have a thickness greater than the thickness of an adjacent lamination of said core.

* * * * *